US008826577B1

(12) United States Patent
Bentley

(10) Patent No.: US 8,826,577 B1
(45) Date of Patent: Sep. 9, 2014

(54) SHOTGUN SHOULDER STOCK SHELL CARRIER

(71) Applicant: Krow Innovation, LLC, Nampa, ID (US)

(72) Inventor: James K. Bentley, Eagle, ID (US)

(73) Assignee: Krow Innovation, LLC, Nampa, ID (US)

( * ) Notice: Subject to any disclaimer, the term of this patent is extended or adjusted under 35 U.S.C. 154(b) by 0 days.

(21) Appl. No.: 14/072,671

(22) Filed: Nov. 5, 2013

(51) Int. Cl.
*F41A 9/72* (2006.01)
*F41C 23/22* (2006.01)

(52) U.S. Cl.
CPC ..... *F41C 23/22* (2013.01)
USPC ..... 42/49.01; 42/71.01; 89/33.1

(58) Field of Classification Search
CPC ..... F41C 23/16; F41C 23/22; F41C 23/20; F41C 23/12; F41C 23/00; F41C 27/00; F41A 9/72; F41A 9/68; F41A 9/61
USPC ..... 42/71.01, 72, 49.01, 49.1, 6; 89/33.1
See application file for complete search history.

(56) References Cited

U.S. PATENT DOCUMENTS 1,526,847 A * 2/1925 Fritz ..... 42/71.01
4,850,127 A * 7/1989 Davis et al. ..... 42/71.01
5,159,136 A * 10/1992 Marsh ..... 42/71.01
5,225,613 A * 7/1993 Claridge ..... 42/74
D382,037 S * 8/1997 Scott et al. ..... D22/108
5,813,157 A * 9/1998 Scott et al. ..... 42/71.01
6,543,172 B1 * 4/2003 Armstrong ..... 42/71.01
6,829,855 B2 * 12/2004 Seifert ..... 42/90
6,952,896 B2 * 10/2005 Davis ..... 42/71.01
7,503,137 B2 * 3/2009 Filicietti ..... 42/71.01
7,805,873 B2 * 10/2010 Bentley ..... 42/74
7,937,873 B2 * 5/2011 Keng ..... 42/71.01
8,122,635 B2 * 2/2012 Pullicar ..... 42/71.01
8,327,568 B1 * 12/2012 Lavergne et al. ..... 42/71.01
8,353,123 B2 * 1/2013 Pullicar et al. ..... 42/72
8,555,541 B2 * 10/2013 Ingram ..... 42/71.01
2004/0060220 A1 * 4/2004 Peddie ..... 42/71.01
2005/0183315 A1 * 8/2005 Davis ..... 42/71.01
2007/0101631 A1 * 5/2007 Bentley ..... 42/74
2007/0261284 A1 * 11/2007 Keng ..... 42/73
2008/0190004 A1 * 8/2008 Filicietti ..... 42/71.01
2011/0099872 A1 * 5/2011 Bentley et al. ..... 42/71.01
2011/0173863 A1 * 7/2011 Ingram ..... 42/73
2011/0225864 A1 * 9/2011 Pullicar et al. ..... 42/71.01
2013/0081314 A1 * 4/2013 Hatfield ..... 42/1.02
2014/0000143 A1 * 1/2014 Safewright, Jr. ..... 42/49.02

FOREIGN PATENT DOCUMENTS

WO WO 2007137735 A1 * 12/2007 ..... F41C 23/20

* cited by examiner

*Primary Examiner* — Benjamin P Lee
(74) *Attorney, Agent, or Firm* — Parsons Behle & Latimer

(57) ABSTRACT

A rear stock for a shotgun that includes at least one tube adapted for the storage of shotgun shells. The rear stock may include a tube positioned on each side of the stock for the storage of a plurality of shotgun shells. A switch slideably mounted to the front of the stock may be moved toward one of the tubes to partially eject a portion of a shotgun shell positioned with the tube. A protrusion connected to the switch extends into a portion of the tube and movement of the switch towards a side of the stock engages the protrusion against a shell stored in the tube. The continued movement of the protrusion forces a portion of the shell against a tapered surface on an internal shoulder cause a portion of the shell to be ejected from the tube within the stock.

19 Claims, 3 Drawing Sheets

SHOTGUN SHOULDER STOCK SHELL CARRIER

BACKGROUND

1. Field of the Disclosure

The embodiments described herein relate to a shoulder stock for a shotgun that includes at least one internal shell carrier tube.

2. Description of the Related Art

Under many circumstances it may be desirable to rapidly load and fire rounds of ammunition from a shotgun. The ability to rapidly reload a shotgun for subsequent firing may increase the effectiveness of the firearm. For example, in law enforcement and/or military activities, it may be highly desirable to be able to rapidly load a shotgun. In some sporting events, was a hunting and shooting sporting clays, the ability to rapidly reload and fire a shotgun may be beneficial in increasing the shooters performance. The convenient storage of additional shotgun shells may aid in the rapid reloading of a shotgun. However, the area of a shotgun available for the storage of additional shells may be limited. For example, the available storage areas may be off the side of the receiver, one side of the stock, and/or one side of some forends.

The desire to carry and load shotgun shells has been previously attempted in various ways, such as aftermarket external shot shell carriers that may be mechanically attached to a portion of a shotgun. However, the attachment of such an external storing device may be cumbersome and present the potential of becoming snagged on various obstacles. Clothing and/or shot shell belts have also been used to store additional shotgun shells. The use of clothing and/or shot shell belts may require the shooter to remove his hand from the firearm to retrieve additional shells.

There is a need to provide an additional shot shell storage that is internal to the shotgun that permits the rapid retrieval of shot shells to be loaded into the shotgun when necessary.

SUMMARY

The present disclosure is directed to a rear stock having at least one shotgun shell carrier or storage tube that overcomes some of the problems and disadvantages discussed above.

One embodiment is a stock for a shotgun comprising a main body having a forward end, a rearward end, a first sidewall, and a second sidewall. The rearward end is adapted to engage a shoulder of a shooter. The stock includes a first shot shell tube disposed in the main body adapted to receive at least one shotgun shell and an opening in the first sidewall adapted to permit the insertion of at least one shotgun shell into the first shot shell tube. The stock includes a first internal shoulder positioned at a forward end of the first shot shell tube and a first biasing mechanism to bias a shotgun shell positioned within the first shot shell tube against the first internal shoulder. The stock includes an injection member slideably connected to the forward end of the main body. The ejection member is adapted to engage and move a portion of a shotgun shell positioned against the first internal shoulder out of the first shot shell tube upon movement of the ejection member along the forward end of the main body towards the first sidewall.

The stock may include a second shot shell tube disposed in the main body adapted to receive at least one shotgun shell and an opening in the second sidewall adapted to permit the insertion of at least one shotgun shell into the second shot shell tube. The stock may include a second internal shoulder positioned at a forward end of the second shot shell tube and a second biasing mechanism to bias a shotgun shell positioned within the second shot shell tube against the second internal shoulder. The ejection member may be adapted to engage and move a portion of a shotgun shell positioned against the second internal shoulder out of the second shot shell tube upon movement of the ejection member along the forward end of the main body towards the second sidewall.

The first internal shoulder may include a first tapered surface positioned adjacent to the opening in the first sidewall, wherein movement of the ejection member forces a portion of a shotgun shell positioned against the first internal shoulder to engage the tapered surface to move a portion of the shotgun shell out of the first shot shell tube. The second internal shoulder may include a second tapered surface positioned adjacent to the opening in the second sidewall, wherein movement of the ejection member forces a portion of a shotgun shell positioned against the second internal shoulder to engage the second tapered surface to move the portion of a shotgun shell out of the second shot shell tube. The ejection member may include an external switch adapted to be actuated by a user and an internal protrusion adapted to engage a portion of a shotgun shell positioned against the first internal shoulder. The first biasing mechanism may comprise a spring and a member with the first end of a spring being connected to a rear end of the first shot shell tube and the member being connected to the second end of the spring.

One embodiment is a stock for a shotgun comprising a body adapted to be connected to a shotgun. The body includes a first shot shell tube, a second shot shell tube, a first opening, and a second opening. The first shot shell tube and the second shot shell tube are substantially parallel. The first opening exposes a portion of the first shot shell tube and the second opening exposes a portion of the second shot shell tube. The stock includes a first biasing mechanism positioned with the first shot shell tube and a second biasing mechanism positioned within the second shot shell tube. The stock includes a switch slideably connected to the body adjacent to the first opening and adjacent to the second opening. A portion of the switch extends within the body. The switch has a first position, a second position, and a third position, the first position being between the second position and the third position. In the second position, the portion of the switch extends into the first shot shell tube and, in the third position, the portion of the switch extends into the second shot shell tube.

The body of the stock may include a first end and a second end, wherein the first end is adapted to engage a shoulder of a user and the second end comprising a third opening adapted to engage a tube. The body may be adapted to telescope along the tube engaged within the third opening. The stock may include a first internal shoulder within the first shot shell tube and a second internal shoulder within the second shot shell tube. The first shot shell tube may be adapted to selectively retain at least two shotgun shells and the second shot shell tube may be adapted to selectively retain at least two shotgun shells. The stock may include a first tapered surface on the first internal shoulder and a second tapered surface on the second internal shoulder. The first tapered surface may selectively retain a shotgun shell within the first shot shell tube and the second tapered surface may selectively retain a shotgun shell within the second shot shell tube. Movement of the switch to the second position may move a shotgun shell along the first tapered surface to partially eject a portion of the shotgun shell out the first opening. Movement of the switch to the third position may move a shotgun shell along the second tapered surface to partially eject a portion of the shotgun shell out the second opening.

One embodiment is a method for selectively storing and retrieving a shotgun shell from a shoulder stock of a shotgun comprising inserting a first end of a first shotgun shell into a first opening of a first shot shell tube within a shoulder stock, the first shotgun shell comprising a first and a second end, the second end including a primer. The method includes depressing a first biasing mechanism with the first end of the first shotgun shell until the second end of the first shotgun shell enters the first opening of the first shot shell tube and releasing the first shotgun shell, wherein the first biasing mechanism pushes the second end of the first shotgun sell against a first internal shoulder of the first shot shell tube. The method includes sliding a switch towards the first shot shell tube, wherein a portion of the switch engages a portion of the second end of the first shotgun shell to partially eject the second end of the first shotgun shell from the first opening.

The method may include inserting a first end of a second shotgun shell into a second opening of a second shot shell tube within a shoulder stock, the second shotgun shell comprising a first end and a second end, the second end including a primer. The method may include depressing a second biasing mechanism with the first end of the second shotgun shell until the second end of the second shotgun shell enters the second opening of the second shot shell tube and releasing the second shotgun shell, wherein the second biasing mechanism pushes the second end of the second shotgun shell against a second internal shoulder of the second the second shot shell tube. The method may include sliding the switch towards the second shot shell tube, wherein a portion of the switch engages a portion of the second end of the second shotgun shell to partially eject the second end of the second shotgun shell from the second opening.

After first and second shotgun shells have already been inserted into the stock and held within, the method may include inserting a first of a third shotgun shell into the first opening of the first shot shell tube within the shoulder stock, the third shotgun shell comprising the first end and a second end, the second end including a primer and depressing the first biasing mechanism and the first shotgun shell with the first end of the third shotgun shell until the second end of the third shotgun shell enters the first opening of the first shot shell tube. The method may include releasing the third shotgun shell, wherein the first biasing mechanism and the first shotgun shell pushes the second end of the third shotgun shell against the first internal shoulder of the first shot shell tube. The method may include sliding the switch towards the first shot shell tube, wherein a portion of the switch engages a portion of the second end of the third shotgun shell to partially eject the second end of the third shotgun shell from the first opening. The method may include removing the third shotgun shell from the first shot shell tube, wherein upon removal of the third shotgun shell the first biasing mechanism pushes the second end of the first shotgun shell against the first internal shoulder of the first shot shell tube.

One embodiment is a method of manufacturing a rear stock for a shotgun comprising providing a rear stock for attachment to a shotgun and providing a first shot shell tube within the rear stock. The method includes providing a first opening configured to provide access to the first shot shell tube and providing a first biasing mechanism within the first shot shell tube, wherein the first biasing mechanism biases a shotgun shell against a first internal shoulder within the first shot shell tube. The method includes providing a switch slideably connected to a front portion of the rear stock, wherein the movement of the switch towards the first shot shell tube selectively ejects a shotgun shell positioned against the first internal shoulder.

The method may include providing a second shot shell tube within the rear stock and providing a second opening configured to provide access to the second shot shell tube. The method may include providing a second biasing mechanism within the second shot shell tube, wherein the second biasing mechanism biases a shotgun shell against a second internal shoulder within the second shot shell tube. Movement of the switch towards the second shot shell tube selectively ejects a shotgun shell positioned against the second internal shoulder. The method may include providing a third opening in the rear stock, the third opening being adapted to engage a tube connected to a receiver of a shotgun.

Figure 1:
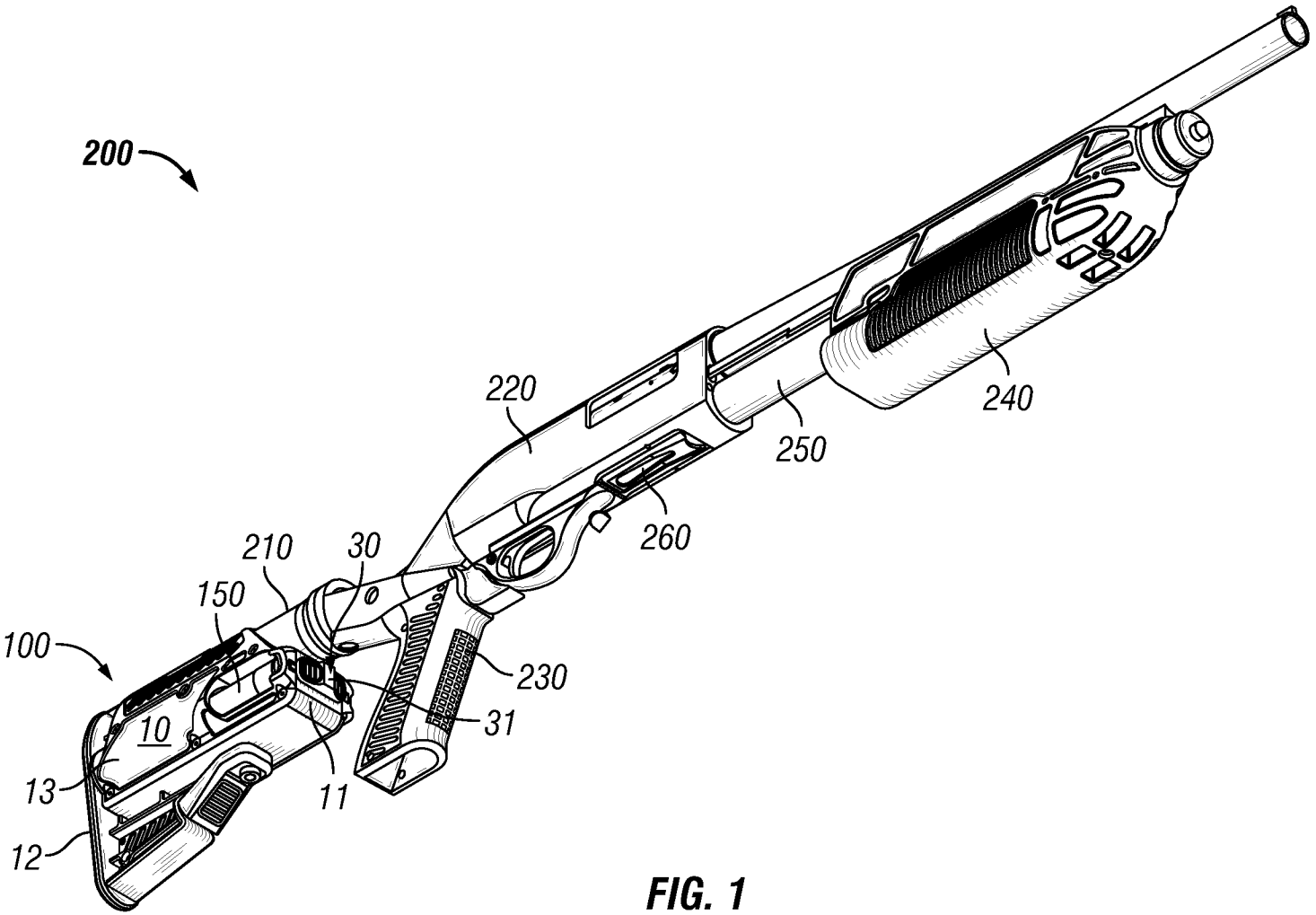
FIG. 1 shows one embodiment of a rear stock having internal shell carrier tubes, the rear stock being connected to a shotgun.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a shotgun 200 that includes a rear stock 100 connected to the shotgun 200 via a telescoping tube 210. The rear stock 100 is adapted to telescope on telescoping tube 210 to change the overall length of the firearm as would be appreciated by one of ordinary skill in the art. The rearward end 12 of the rear stock 100 is adapted to engage the shoulder of a person operating the shotgun 200. The operator may grip the pistol grip 230 of the shotgun 200 with one hand and position the other hand on a forward position of the shotgun, such as on the forend 240. Shotgun shells, also referred to herein as shot shells, 150 may be loaded into a magazine tube 250 via port 260 and the magazine tube 250 may be actuated to load a shot shell 150 into the receiver 220, as would be appreciated by one of ordinary skill in the art. The forend 240 may include the capacity to hold shot shells 150 such as the forend disclosed in U.S. Pat. No. 8,122,635 and U.S. Pat. No. 8,353,123, both of which are herein incorporated by reference in their entireties.

Figure 3:
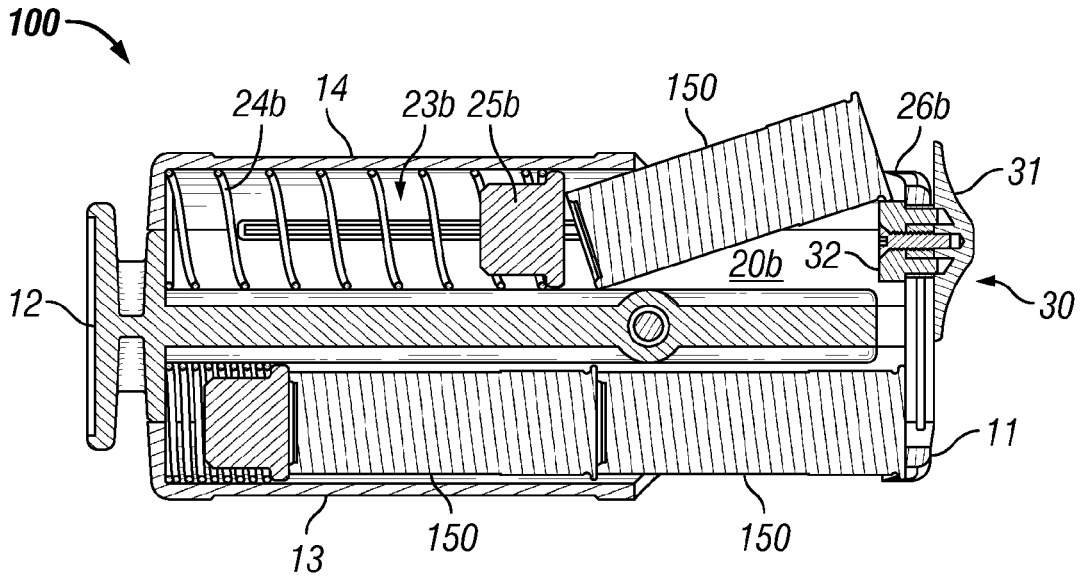
FIG. 3 is a partial cross-section top view of one embodiment of a rear stock with a shell carrier tube.

The rear stock 100 of FIG. 1 includes a body 10 that has a front end 11, rear end 12, a first side 13, and a second side 14 (shown in FIG. 3). The body includes at least one shot shell carrier tube, also referred to as a storage tube, integral to the body 10 that is adapted to store at least one shot shell 150. Preferably, the body 10 includes two shot shell tubes 20*a*, 20*b*, adapted to hold at least two shot shells 150 per tube 20*a*, 20*b*. An ejection member, also referred to as a switch, 30 is slideably connected to the front end 11 of body 10 of the rear stock 100. The ejection member 30 includes a portion or protrusion 32 that extends into the body and is used to partially eject a shot shell 150 stored within a shot shell tube 20*a*, 20*b*, as will be discussed in more detail below. The ejection member 30 also includes a portion 31 external to the body 10 that may be manipulated by an operator of the shotgun 200 to eject a shot shell 150 from either shot shell tube 20*a*, 20*b*.

Figure 2:
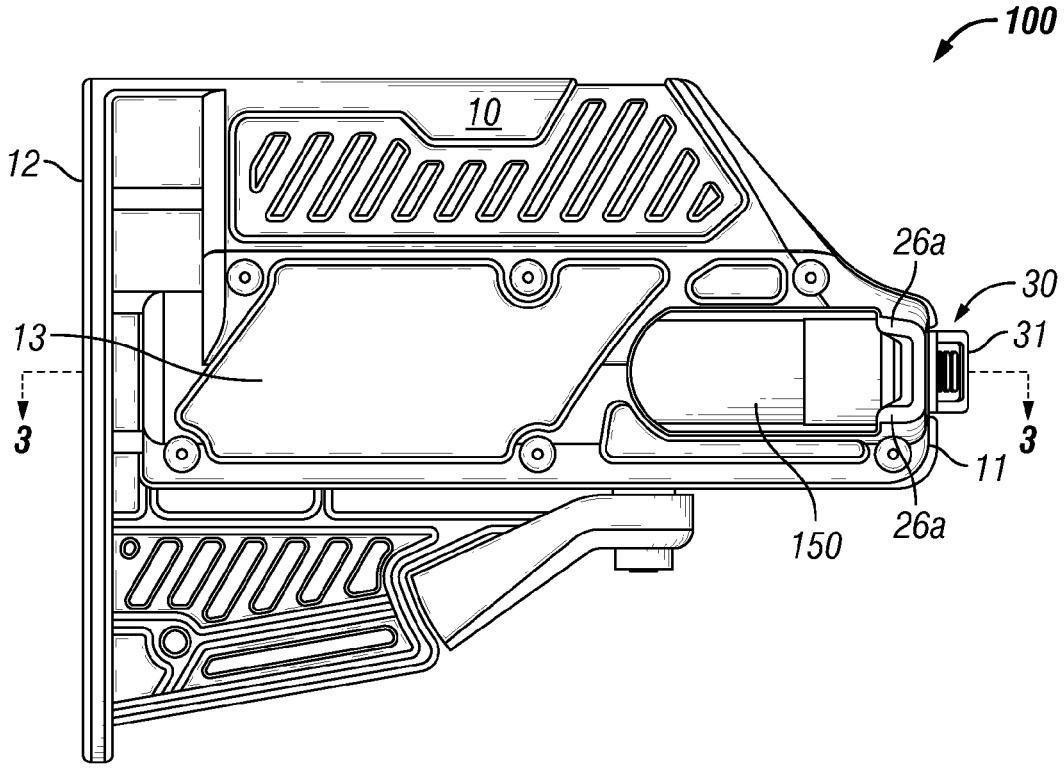
FIG. 2 is a side view of one embodiment of a rear stock with an internal shell carrier tube.

FIG. 2 shows a side view of an embodiment of a rear stock 100 that includes a shot shell tube for the storage of a shot shell 150. As discussed above, the body 10 of the rear stock 100 includes a rear end 12 adapted to be engaged by the shoulder of an operator of a shotgun 200. FIG. 2 shows the portion 31 of the ejection member 30 that is external of the body 10 of the rear stock 100. The ejection member 30 is slideably mounted to the front end 11 of the body 10. The shot shell 150 may be inserted into the shot shell tube 20*a* (shown in FIG. 4) of the first side 13 via an opening 21*a* (shown in FIG. 4) in the first side 13 of the body 10. An internal shoulder 22*a* (shown in FIG. 4) within the shot shell tube 20*a* includes at least one tapered surface 26*a*, which may aid in the ejection of the shot shell 150 from the shot shell tube 20*a*. The position of the tapered surface 26*a* may also help to retain the shot shell 150 within the shot shell tube 20*a* prior to the ejection member 30 being actuated by the operator. For example, the tapered surface 26*a* may be adjacent the opening 21*a* and, thus may provide an edge or lip to help selectively retain the shot shell 150 within the shot shell tube 20*a* until the ejection member 30 is actuated to remove a shot shell 150 from the tube 20*a*.

FIG. 3 shows a partial cross-section top view of the rear stock 100, which includes two shot shell tubes 20*a* (shown in FIG. 4) and 20*b*. Two shot shells 150 are stored within a first tube 20*a* that is accessed through an opening 21*a* in the first side 13 of the body 10. The shot shells 150 are inserted nose, or casing, first in into the shot shell tubes. A biasing mechanism 23*a*, 23*b* pushes the primer end of the shot shell 150 against an internal shoulder 22*a*, 22*b* within the shot shell tubes 20*a*, 20*b* to retain the shot shell 150 within the shot shell tubes 20*a*, 20*b*.

FIG. 3 shows a shot shell 150 being partially ejected from the second shot shell tube 20*b* that is accessed via an opening 21*b* in the second side 14 of the body. As discussed above, a biasing mechanism 23*b* pushes the shot shell 150 forward within the second shot shell tube 20*b* until the primer end of the shot shell 150 engages an internal shoulder 22*b* within the shot shell tube 20*b*. The biasing mechanism 23*b* may comprise one end of a spring 24*b* connected to the rear end 12 of the body and the other end of the spring 24*b* connected to a member 25*b*. The member 25*b* provides a surface that engages the nose end of the shot shell 150. The spring 24*b* and member 25*b* push the shot shell 150 forward within the tube 20*b* until the end of the shot shell 150 engages the internal shoulder 22*b*. Various other biasing mechanisms may be used to bias the shot shell 150 against the internal shoulder 22*b*. Some examples of additional biasing mechanisms may be, but are not limited to, a spring by itself, a compressible chamber, a piston, or the like.

The ejection member 30 may be used to at least partially eject a portion of the shot shell 150 from the shot shell tube 20*b* so that the shot shell 150 may be grasped by the operator of the stock 100. After retrieving the shot shell 150 from the shot shell tube 20*b*, the shot shell 150 may be loaded into the shotgun 200 via port 260. To remove a shot shell 150 from a shot shell tube 20*b*, the ejection member 30 is moved toward the shot shell tube 20*b* from an initial position (shown in FIG. 4) that is centrally located between the two shot shell tubes 20*a*, 20*b*. The ejection member 30 may be moved to a second position, or third position depending on the shot shell tube 20*a* or 20*b* from which the shot shell 150 is to be ejected, that is in line with the shot shell tube 20*b*, as shown in FIG. 3. FIG. 5 shows the ejection member 30 in line with the other shot shell tube 20*a*, which may be referred to as the first shot shell tube. However, the rear stock 100 may be symmetrical and thus, either side may be considered the first side or second side with either shot shell tube being considered the first shot shell tube or the second shot shell tube.

The ejection member 30 is moved along the front 11 of the body 10 of the rear stock 100 towards the tube 20*a* or 20*b* from which a shot shell 150 is to be removed. An inner projection 32 of the ejection member 30 engages a portion of the shot shell 150 pushing the shot shell 150 against a tapered surface or portion 26*b* of the internal shoulder 22*b*. Preferably, the inner projection 32 engages a portion of the primer end of the shot shell 150. The movement of the shot shell 150 against the tapered surface 26*b* causes at least a portion of the shot shell 150 to moved out of the opening 21*b* permitting the operator of the stock 100 to retrieve the shell 150. Optionally, the shot shell 150 may be completely ejected from the shot shell tube 20*b* depending on the force applied by the biasing mechanism 23*b* and the force applied by the ejection member 30.

The biasing mechanism 23*b* continuously applies a forward force on shot shells 150 positioned with the shot shell tube 20*b*. When a first shot shell 150 is removed from the shot shell tube 20*b*, the biasing mechanism 23 pushes a second shot 150, if one is positioned within the shot shell tube 20*b*, forward until the primer end of the shot shell 150 engages the internal shoulder 22*b* of the shot shell tube 20*b*. The second shot shell 150 may then be removed from the shot shell tube 20*b* by actuation of the ejection member 30 as discussed above. The biasing mechanism 23*a* of the first shot shell tube 20*a* operates in the same manner.

Figure 4:
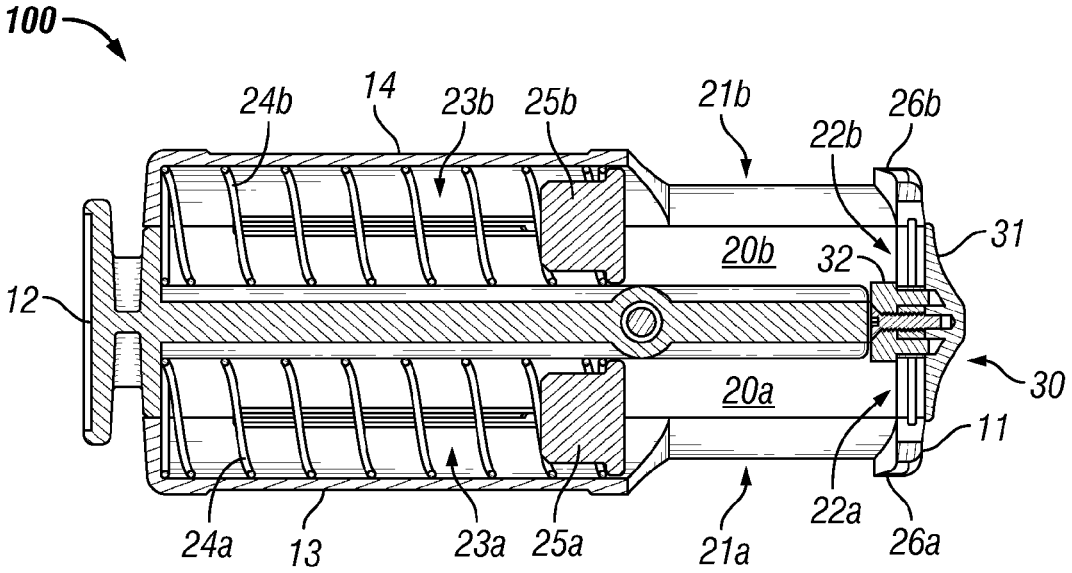
FIG. 4 shows is a partial cross-section top view of one embodiment of a rear stock having internal shell carrier tubes.
Figure 5:
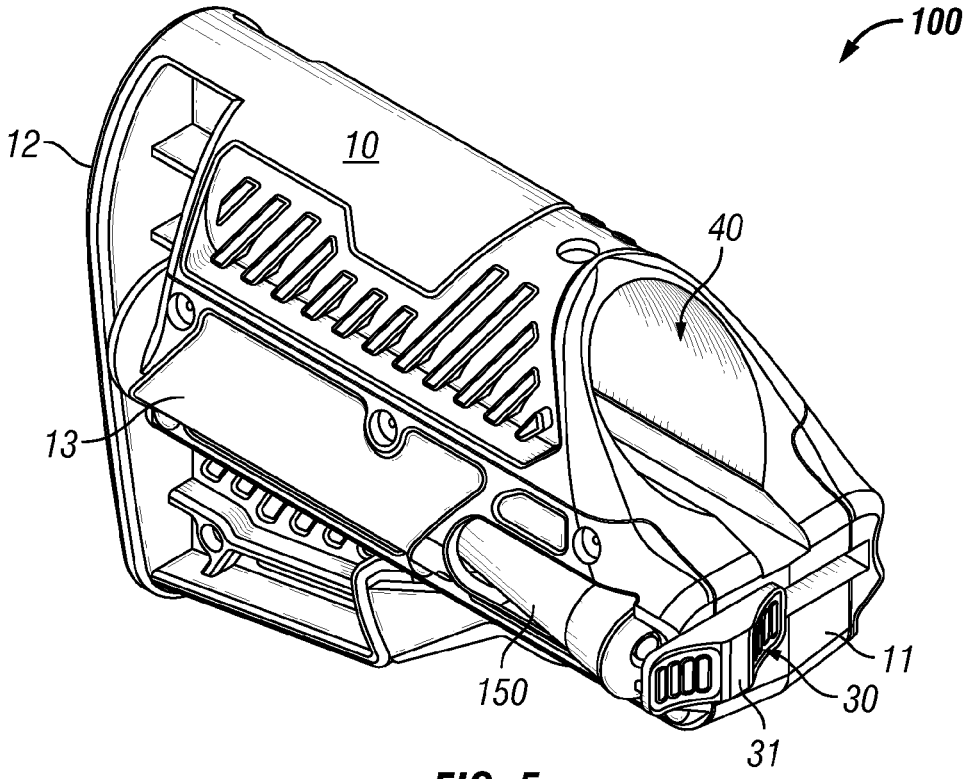
FIG. 5 shows a perspective view of one embodiment of a rear stock with a shell carrier tube.

FIG. 4 shows a partial cross-section top view of a rear stock 100 having a first shot shell tube 20*a* and a second shot shell tube 20*b*. FIG. 4 shows the ejection member 30 in its initial or first position, which is positioned centrally between the first and second shot shell tubes 20*a*, 20*b*. The nose or casing end of a shot shell 150 may be inserted into a first opening 21*a* in the first side 13 to position and store the shot shell 150 within the first shot shell tube 20*a*. The movement of the shot shell 150 into the tube 20*a* will depress the biasing mechanism 23*a*, which may be comprised of a member 25*a* connected to an end of a spring 24*a*. Once the shell 150 is inserted into the tube 20*a* and released by the operator, the biasing mechanism 23*a* will push the primer end of the shot shell 150 against a first internal shoulder 22*a* within the first shot shell tube 20*a* at the front end 11 of the rear stock 100. The first internal shoulder 22*a* of the first shot shell tube 20*a* includes a tapered portion or surface 26*a*, which facilitates the removal of a shot shell 150 from the tube when the internal projection 32 of the ejection member pushes against the shot shell 150 in the direction of the first opening 21*a*. The external portion 31 of the ejection member 30 may be manipulated by the operator to move the ejection member 30 towards either the first opening 21*a* or the second opening 21*b*.

The insertion of a shell 150 into and ejection of a shell 150 out of the second shot shell tube 20*b* operates in the same manner as in regards to the first shot shell tube 20*a*. The shell 150 may be inserted into the second shot shell tube 20 via an opening 21*b* in the second side 14 of the body 10. The shell 150 will also be at least partially ejected from the opening 21*b* when engaged by the internal projection 32 and pushed against the tapered surface 26*b* of the internal shoulder 22*b* of the second tube 20*b*.

FIG. 5 shows an isometric view of an embodiment of rear stock 100 with a shot shell 150 being partially ejected from a shot shell tube 20*a* through the opening 21*a* in the first side 13 of the body. The ejection member, or switch, 30 has been moved along the front side 11 of the body 10 towards the first tube 20*a* causing the internal projection 32 to push at least a portion of the shot shell 150 out of the opening 21*a* so that it may be retrieved by the operator. The body 10 includes an opening 40 above the shot shell tubes 20*a*, 20*b* that is adapted to receive a tube 210 (shown in FIG. 1) to connect the stock 100 to a shotgun 200 (shown in FIG. 1).

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

TABLE OF REFERENCE NUMERALS FOR FIGS. 1-5

10—main Body
11—front end
12—rear end
13—first sidewall
14—second sidewall
20*a*—first tube in body
20*b*—second tube in body
21*a*—first opening in sidewall for insertion of shotgun shell
21*b*—second opening in sidewall for insertion of shotgun shell
22*a*—first internal shoulder
22*b*—second internal shoulder
23*a*—first biasing mechanism
23*b*—second biasing mechanism
24*a*—first spring
24*b*—second spring
25*a*—first member attached to first spring
25*b*—second member attached to second spring
26*a*—tapered portion of first internal shoulder
26*b*—tapered portion of second internal shoulder
30—ejection member
31—external switch of ejection member
32—internal protrusion of ejection member
40—opening for stock tube
100—stock
150—shotgun shell
200—shotgun
210—telescoping tube
220—receiver of shotgun
230—pistol grip
240—forend
250—magazine tube
260—loading port

What is claimed is:

1. A stock for a shotgun, the stock comprising:

a main body having a forward end, a rearward end, a first sidewall, and a second sidewall, the rearward end being adapted to engage a shoulder of a shooter;

a first shot shell tube disposed in the main body adapted to receive at least one shotgun shell, an opening in the first sidewall adapted to permit the insertion of at least one shotgun shell into the first shot shell tube;

a first internal shoulder positioned at a forward end of the first shot shell tube;

a first biasing mechanism to bias a shotgun shell positioned within the first shot shell tube against the first internal shoulder;

a second shot shell tube disposed in the main body adapted to receive at least one shotgun shell, an opening in the second sidewall adapted to permit the insertion of at least one shotgun shell into the second shot shell tube;

a second internal shoulder positioned at a forward end of the second shot shell tube;

a second biasing mechanism to bias a shotgun shell positioned within the second shot shell tube against the second internal shoulder; and an ejection member slideably connected to the forward end of the main body, the ejection member is adapted to engage and move a portion of a shotgun shell positioned against the first internal shoulder out of the first shot shell tube upon movement of the ejection member along the forward end of the main body towards the first sidewall and the ejection member is adapted to engage and move a portion of a shotgun shell positioned against the second internal shoulder out of the second shot shell tube upon movement of the ejection member along the forward end of the main body towards the second sidewall.

2. The stock of claim 1, the first internal shoulder further comprising a first tapered surface positioned adjacent to the opening in the first sidewall, wherein movement of the ejection member forces a portion of a shotgun shell positioned against the first internal shoulder to engage the first tapered surface to move a portion of the shotgun shell out of the first shot shell tube.

3. The stock of claim 2, the second internal shoulder further comprising a second tapered surface positioned adjacent to the opening in the second sidewall, wherein movement of the ejection member forces a portion of a shotgun shell positioned against the second internal shoulder to engage the second tapered surface to move the portion of a shotgun shell out of the second shot shell tube.

4. The stock of claim 1, the ejection member further comprising an external switch adapted to be actuated by a user and an internal protrusion adapted to engage a portion of a shotgun shell positioned against the first internal shoulder.

5. The stock of claim 1, the first biasing mechanism further comprising a spring and a member, a first end of the spring being connected to a rear end of the first shot shell tube and the member being connected to a second end of the spring.

6. A stock for a shotgun, the stock comprising:

a body adapted to be connected to a shotgun, the body comprising a first shot shell tube, a second shot shell tube, a first opening, and a second opening, the first shot shell tube and the second shot shell tube being substantially parallel, the first opening exposes a portion of the first shot shell tube, and the second opening exposes a portion of the second shot shell tube;

a first biasing mechanism positioned within the first shot shell tube;

a second biasing mechanism positioned within the second shot shell tube; and a switch slideably connected to the body adjacent to the first opening and adjacent to the second opening, a portion of the switch extends within the body, the switch have a first position, a second position, and a third position, the first position being between the second position and third position;

wherein in the second position the portion of the switch extends into the first shot shell tube and wherein in the third position the portion of the switch extends into the second shot shell tube.

7. The stock of claim 6, the body further comprising a first end and a second end, wherein the first end is adapted to engage a shoulder of a user and the second end comprises a third opening adapted to engage a tube.

8. The stock of claim 7, wherein the body is adapted to telescope along the tube engaged within the third opening.

9. The stock of claim 6, further comprising a first internal shoulder within the first shot shell tube and a second internal shoulder within the second shot shell tube.

10. The stock of claim 9, wherein the first shot shell tube is adapted to selectively retain at least two shotgun shells and wherein the second shot shell tube is adapted to selectively retain at least two shotgun shells.

11. The stock of claim 10, furthering comprising a first tapered surface on the first internal shoulder and a second tapered surface on the second internal shoulder, wherein the first tapered surface selectively retains a shotgun shell within the first shot shell tube and wherein the second tapered surface selectively retains a shotgun shell within the second shot shell tube.

12. The stock of claim 11, wherein movement of the switch to the second position moves the shotgun shell along the first tapered surface to partially eject a portion of the shotgun shell out the first opening.

13. The stock of claim 12, wherein movement of the switch to the third position moves the shotgun shell along the second tapered surface to partially eject a portion of the shotgun shell out the second opening.

14. A method for selectively storing and retrieving a shotgun shell from a shoulder stock of a shotgun, the method comprising:

inserting a first end of a first shotgun shell into a first opening of a first shot shell tube within a shoulder stock, the first shotgun shell comprising the first end and a second end, the second end including a primer;

depressing a first biasing mechanism with the first end of the first shotgun shell until the second end of the first shotgun shell enters the first opening of the first shot shell tube;

releasing the first shotgun shell, wherein the first biasing mechanism pushes the second end of the first shotgun shell against a first internal shoulder of the first shot shell tube; and sliding a switch towards the first shot shell tube, wherein a portion of the switch engages a portion of the second end of the first shotgun shell to partially eject the second end of the first shotgun shell from the first opening.

15. The method of claim 14, further comprising:

inserting a first end of a second shotgun shell into a second opening of a second shot shell tube within a shoulder stock, the second shotgun shell comprising the first end and a second end, the second end including a primer;

depressing a second biasing mechanism with the first end of the second shotgun shell until the second end of the second shotgun shell enters the second opening of the second shot shell tube;

releasing the second shotgun shell, wherein the second biasing mechanism pushes the second end of the second shotgun shell against a second internal shoulder of the second shot shell tube; and sliding the switch towards the second shot shell tube, wherein the portion of the switch engages a portion of the second end of the second shotgun shell to partially eject the second end of the second shotgun shell from the second opening.

16. The method of claim 14, wherein the first and second shotgun shells have already been inserted into the stock and are held within, the method further comprising:

inserting a first end of a third shotgun shell into the first opening of the first shot shell tube within the shoulder stock, the third shotgun shell comprising the first end and a second end, the second end including a primer;

depressing the first biasing mechanism and the first shotgun shell with the first end of the third shotgun shell until the second end of the third shotgun shell enters the first opening of the first shot shell tube;

releasing the third shotgun shell, wherein the first biasing mechanism and the first shotgun shell pushes the second end of the third shotgun shell against the first internal shoulder of the first shot shell tube;

sliding the switch towards the first shot shell tube, wherein a portion of the switch engages a portion of the second end of the third shotgun shell to partially eject the second end of the third shotgun shell from the first opening; and removing the third shotgun shell from the first shot shell tube, wherein upon removal of the third shotgun shell the first biasing mechanism pushes the second end of the first shotgun shell against the first internal shoulder of the first shot shell tube.

17. A method of manufacturing a rear stock for a shotgun, the method comprising providing a rear stock for attachment to a shotgun;

providing a first shot shell tube within the rear stock;

providing a first opening configured to provide access to the first shot shell tube;

providing a first biasing mechanism within the first shot shell tube, wherein the first biasing mechanism biases a shotgun shell against a first internal shoulder within the first shot shell tube; and providing a switch slideably connected to a front portion of the rear stock, wherein movement of the switch towards the first shot shell tube selectively ejects a shotgun shell positioned against the first internal shoulder.

18. The method of claim 17 further comprising:

providing a second shot shell tube within the rear stock;

providing a second opening configured to provide access to the second shot shell tube;

providing a second biasing mechanism within the second shot shell tube, wherein the second biasing mechanism biases a shotgun shell against a second internal shoulder within the second shot shell tube; and wherein movement of the switch towards the second shot shell tube selectively ejects a shotgun shell positioned against the second internal shoulder.

19. The method of claim 18 further comprising providing a third opening in the rear stock, wherein the third opening is adapted to engage a tube connected to a receiver of a shotgun.

* * * * *